United States Patent [19]

Corato et al.

[11] Patent Number: 4,674,975

[45] Date of Patent: Jun. 23, 1987

[54] METHOD AND TUNNEL TYPE FURNACE FOR CALCINING CARBONACEOUS BODIES, IN PARTICULAR ELECTRODES

[75] Inventors: Renzo Corato, Mestre; Giulio Ganapini, Genoa; Hans-Anton Meier, Milan; Mauro Poggi, Genoa; Antonio Rosso, Venice; Sergio Sanchioni, Mestre, all of Italy

[73] Assignees: Alusuisse Italia S.p.A., Milan; Italimpianti Società Italiana Impianti p.A., Genoa; Sirma S.p.A., Malcontenta, all of Italy

[21] Appl. No.: 778,646

[22] Filed: Sep. 23, 1985

[30] Foreign Application Priority Data

Sep. 28, 1984 [IT] Italy ..... 22917 A/84

[51] Int. Cl.[4] ..... F27B 9/26

[52] U.S. Cl. ..... 432/11; 432/121; 432/137; 432/145; 432/239

[58] Field of Search ..... 432/11, 121, 136, 137, 432/145, 192, 239

[56] References Cited

U.S. PATENT DOCUMENTS 2,983,022 5/1961 Dressler et al. ..... 432/137
4,128,394 12/1978 Naito et al. ..... 432/145

FOREIGN PATENT DOCUMENTS 2854585 7/1980 Fed. Rep. of Germany ..... 432/239

*Primary Examiner*—Henry C. Yuen
*Attorney, Agent, or Firm*—Guido Modiano; Albert Josif

[57] ABSTRACT

The method comprises passing preformed bodies to be calcined, containing pyrolyzable substances, through a furnace having, arranged in succession, a first heating zone, a second or combustion zone wherein volatile substance released by said bodies are subjected to combustion, a third or calcining zone, and a fourth or cooling zone. Separation means between the first and second zones, and between the third and fourth zones, prevent the flue gases from flowing between such zones.

23 Claims, 9 Drawing Figures

METHOD AND TUNNEL TYPE FURNACE FOR CALCINING CARBONACEOUS BODIES, IN PARTICULAR ELECTRODES

BACKGROUND OF THE INVENTION

The invention relates to a method and a tunnel type furnace for calcining carbonaceous bodies, in particular electrodes such as electrodes for the electrolytic production of aluminum or steel.

In the following description, reference will be made, by way of example, to the manufacture of electrodes for the production of aluminum, it being understood that the invention may also be, with appropriate modifications, applied to the manufacture of other electrodes or generic carbonaceous bodies.

With tunnel type furnaces, preformed bodies to be calcined, comprising a mixture of a carbonaceous matter, such as petroleum coke, anthracite, carbon black, graphite, and the like, with a binder containing pyrolyzable substances, such as tars and/or pitches, are made to pass therethrough on trucks, and are heated in an oxidizing medium or atmosphere such that the volatile substances released from the decomposition and/or distillation of binder fractions can be burned off and the binder itself cokefied.

Such prior tunnel type furnaces have the drawback that, while most of the volatiles are burned off therein, not all of the volatile substances which are released by the binder are burned off, and for this reason, some of these substances comprising essentially organic volatiles, in particular aromatic hydrocarbons, are still exhausted to the atmosphere, resulting in a serious disadvantage from the standpoints of environmental pollution and safety of the working area.

SUMMARY OF THE INVENTION

This invention is directed to improve the methods and tunnel type furnaces therefor, as indicated in the preamble, so as to provide for substantially complete combustion of the volatile substances from the binder of the carbonaceous products, thus affording a better solution to the environmental problems connected with calcining such products, and suitable conditions for a more economical operation of the furnace by an improved utilization of the available heat.

This problem is solved by the invention by virtue of a method of calcining carbonaceous bodies, in particular electrodes, wherein preformed bodies (CA) to be calcined, comprising a mixture of a carbonaceous material and a binder containing pyrolyzable substances, are passed through a tunnel type furnace supplied with an oxidizing atmosphere and having, in succession, a first or heating zone, a second or combustion zone wherein the volatile substances from the binder are burned off in a substantialy complete manner, a third or calcining zone, and a fourth or cooling zone, characterized in that:

(a) in said first zone, the carbonaceous bodies are heated by means of flue gases drawn through at least one intermediate outlet between said second and third zones, said flue gases being introduced into said first zone countercurrently with the movement of said carbonaceous bodies;

(b) in said second zone, a stream of flue gases is established cocurrently with the movement of said carbonaceous bodies toward said intermediate outlet, whereat a furnace temperature of 750°-850° C. and an oxygen content in the furnace atmosphere of at least 1% by volume are maintained, thereby substantially complete combustion of said volatile substances can be ensured;

(c) in said third zone, a stream of flue gases is established countercurrently with the movement of said carbonaceous bodies toward said intermediate outlet, and at least in the portion of said third zone adjoining said intermediate outlet, a sufficient oxygen content is maintained to ensure complete combustion of said volatile substances; and (d) in said fourth zone, cooling air is blown in countercurrently with the movement of said carbonaceous bodies, toward at least one air outlet provided at the initial portion of said fourth zone.

Thus, according to the invention, in the first and third zones of the tunnel type furnace, the carbonaceous bodies are heated in countercurrent, utilizing the higher efficiency of countercurrent heat exchange, while achieving nevertheless, in the third furnace zone, thorough combustion of the volatile substances released in this zone, since the furnace temperature already has at the start of the third zone values in the range of about 750° to 850° C., adequate to ensure complete combustion of said volatile substances. In the furnace fourth zone, cooling of the carbonaceous bodies is also carried out in coutercurrent relationship and accordingly, in a heat exchange condition of the utmost efficiency. It is only in the second zone of the furnace that the carbonaceous bodies are heated in cocurrent relationship, and hence with decreased thermal efficiency; however, by virtue of the cocurrent mode, the flue gases containing the volatiles from the binder in the carbonaceous bodies can be taken to the end portion of the second zone, where the furnace temperature reaches values of about 750°-850° C., appropriate to ensure substantially complete combustion of said volatile substances. Consequently, in a tunnel type furnace according to the invention, all of the environmentally harmful volatiles released by the binder are effectively burned off in combination with the achievement of the utmost possible overall thermal efficiency of the furnace.

Heating of the second and third zones of the furnace according to the invention may be carried out by means of gaseous and/or liquid fuel burners, or at least in part, by utilizing the heat from the combustion of the volatile substances. In the first, and second and third zones of the furnaces, the temperature can be controlled to suit a desired heating curve by blowing in cool and/or heated air. Separation of the first zone from the second, and of the third zone from the fourth, may be accomplished by means of apertured partitions or diaphragms to barely admit the trucks and their loads therethrough. Such partitions may be either single-walled partitions, or preferably, double-wall partitions with an interspace connected to the outside atmosphere. The sought oxygen content in the furnace atmosphere, at the second and third zones thereof, is obtained preferably by blowing in air through side ports. Of preference, these side ports are provided at diagonally opposite locations with respect to the furnace cross-section, that is at the top in one side of the furnace and at the bottom in the opposite side of the furnace, thereby creating crosswise eddies which make the distribution of the oxygen through the furnace atmosphere smoother and contribute, therefore, to the complete combustion of the volatile substances. For the same purpose, the burners in the second and third furnace zones are also preferably provided at diagonally opposite locations with respect to the furnace's cross-section, that is, at the top in one side of the furnace and at the bottom in the other side.

BRIEF DESCRIPTION OF THE DRAWINGS

These and other features of the invention, and the deriving advantages, will be better understood from the following description of an embodiment thereof, with reference to the accompanying illustrative drawings, where.

DESCRIPTION OF THE PREFERRED EMBODIMENTS

Figure 1:
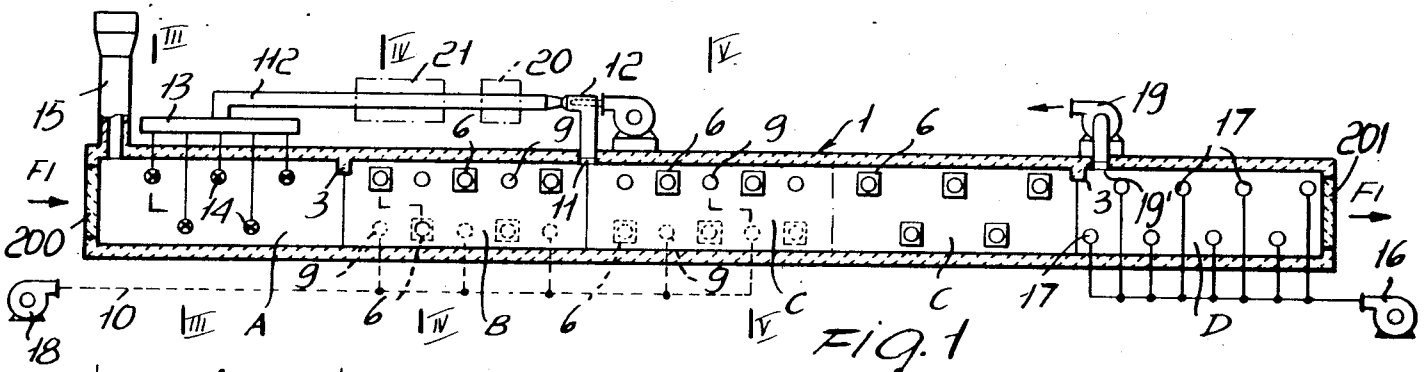
FIG. 1 shows schematically a longitudinal section through a tunnel type furnace according to the invention.

With reference to the drawing figures, a tunnel type furnace 1 according to this invention is intended for calcining carbonaceous bodies CA, in particular electrodes, and specifically anodes for the electrolytic reduction of aluminum. The carbonaceous bodies are generally press-molded or extruded from a mixture of a carbonaceous material, such as petroleum coke, anthracites, carbon black, graphites, or the like, with a binder material containing pyrolyzable susbtances, such as tar and/or pitches. The carbonaceous bodies CA thus prepared are housed in muffles M pervious to gases and vapors, and passed through the tunnel type furnace 1 on trucks 2 which form, in a manner known per se, the moving floor of the furnace and are moved from an entrance end 200 of the tunnel structure in the direction of the arrows F1 in the drawings along the longitudinal downstream extension of the tunnel structure up to the exit end 201 thereof, wherefrom the trucks are removed. The trucks 2 may be constructed and operated in any suitable way, even conventionally, as practiced heretofore with prior tunnel type furnaces, and will be no further discussed herein.

During their passage through the tunnel type furnace 1, the carbonaceous bodies are calcined, that is, their binder is coked. During heating in the temperature range of 200° to 600° C., in particular of 400° to 500° C., the carbonaceous bodies CA being calcined give off volatile organic substances in either gaseous or vapor form, issuing from the decomposition and/or distillation of binder fractions and comprising mainly aromatic hydrocarbons. These volatile substances are burned within the tunnel type furnace 1, which is suitably provided with an oxidizing atmosphere or medium. In order to protect the carbonaceous bodies CA against oxidation during the calcining process, said carbonaceous bodies CA are embedded in a powder and/or granulate material which fills the muffles M and may comprise, as an example, a carbonaceous material and/or inert material, such as sand and/or alumina and/or a ground refractory material. Instead of the muffles M, the carbonaceous bodies CA to be calcined may be carried on simple supports, having no covers and side walls, in which case they can be protected against oxidation by means of antioxidant paints.

Figure 6:
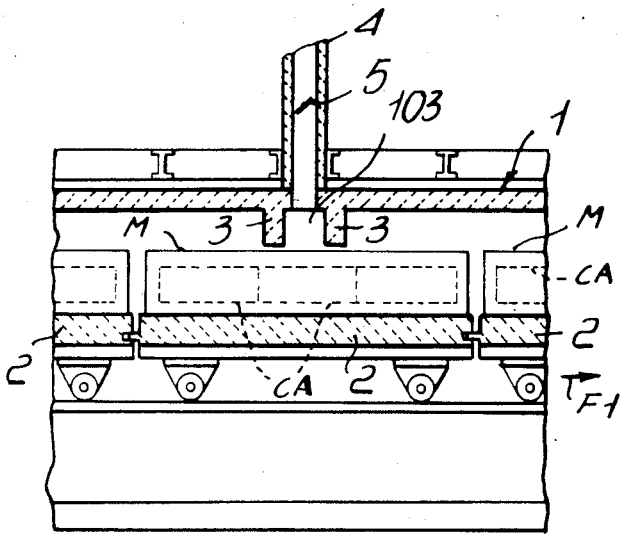
FIG. 6 is a longitudinal section illustrating, on an enlarged scale, the construction of a partition between two furnace zones.

According to the invention, the furnace has four successive zones A,B,C and D. Between the first zone A and second zone B, an apertured partition 3 is provided which may be of single-wall construction, as shown in FIG. 1, or double-wall construction, as indicated at 3—3 in FIG. 6. In the instance of a double-walled partition as in FIG. 6, the interspace 103 between the two walls at 3 would be connected to the outside atmosphere via a small flue 4 having a valve 5. Thus, the same pressure as the outside atmospheric pressure will prevail in said interspace 103. A similar, single-or double-walled, partition 3 is provided between the third zone C and fourth zone D of the furnace. The partitions 3, 3—3 have an aperture which barely admits the trucks 2 with their loads of muffles M therethrough, thereby said partitions will effectively impede flue and other gases from being transferred between the zones A,B, and C,D, thus separated.

In the first zone A of the furnace, the carbonaceous bodies CA are preheated by ambient heat up to a temperature of 200°-300° C. at the end of the zone A itself. The first zone A is heated by flue gases drawn from the furnace at a location between the second zone B and third zone C, as explained hereinafter.

Figure 4:
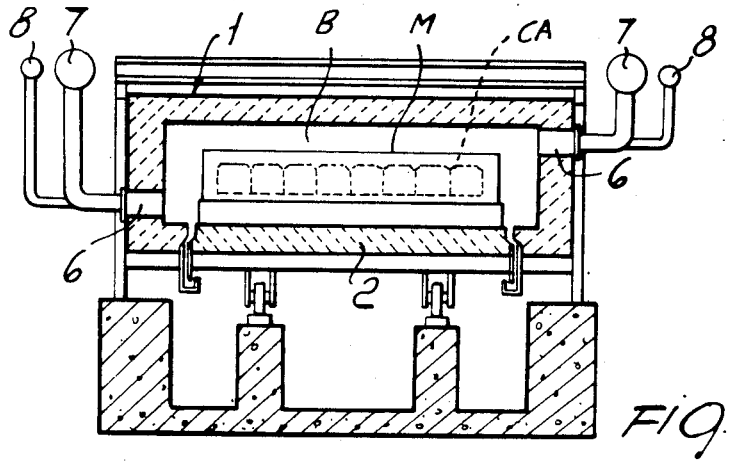
Figure 5:
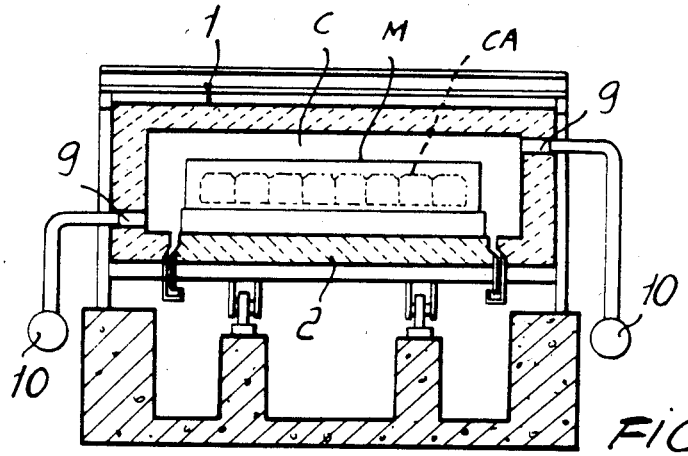

In the second zone B, the carbonaceous bodies CA are heated to a temperature of about 350°-450° C. The second zone B is heated by means of burners 6, each connected to a combustion air manifold 7 and to a fuel manifold 8, the fuel fired into the second zone 8 being gaseous and/or liquid fuel and supplementing the flue gases of said second zone B, as shown detailedly in FIG. 4. The burners 6 are arranged at diagonally opposite loacations with respect to the cross-section of the furnace 1, that is at the top on one side of the furnace and at the bottom on the opposite side thereof, as shown better in FIG. 4. Concurrently therewith, the burners 6 on one side of the furnace are offset in the longitudinal direction of the furnace with respect to the burners 6 located on the opposite side of the furnace, as shown clearly in FIG. 1. Into the zone B of the furnace, there are blown oxygen containing gases in the form of either cool or heated air, in order to maintain the oxidizing atmosphere within the furnace and ensure combustion of the volatile substances which begin to develop in the zone B from the decomposition and/or distillation of the binder of the carbonaceous bodies CA. The air is blown in by a fan 18 through the side ports 9 which are connected to respective air manifolds 10 and arranged—similarly to the burners 6—at diagonally opposite locations with respect to the furnace cross-section, i.e. at the top on one side of the furnace and at the bottom on the opposite side, as shown clearly in FIG. 5. The air intake ports 9 on one side of the furnace are also offset in the longitudinal direction of the furnace relatively to the ports 9 on the opposite side of the furnace, as shown in FIG. 1. In actual practice, on each side of the furnace 1, the air intake ports 9 are located in between the burners 6 on the same side of the furnace 1. By virtue of the above-described arrangement of the burners 6 and air intake ports 9, a turbulent flow is achieved for the combustion gases of the burners 6 and the air blown in through the ports 9, across the direction F1 of advancement of the trucks 2 with the charges to be calcined, thereby the muffles M are swept on all sides by both the combustion gases from the burners 6 and the air blown in through the ports 9, thus ensuring both uniform heating of the carbonaceous bodies CA and combustion of the volatile substances issuing from the muffles M.

The third zone C of the furnace 1 is only separated from the preceding zone B by the common outlet 11 for the flue gases provided between such zones, B and C. In the zone C, the carbonaceous bodies CA are heated up to the desired calcination temperature of about 1000°-1200° C. In the third zone C, there are distinguished two parts, C' and C''. At the end of the first part C', the temperature of the carbonaceous bodies CA reaches approximately 600°-800° C., while the release of the volatile substances from the binder in the carbonaceous bodies CA continues. Accordingly, in this first part C' of the third zone C, in addition to the burners 6 firing fuel into said third zone C, there are also provided side ports 9 for blowing in further oxygen containing gases in the form of cool or heated air in the required amounts to ensure combustion of the volatile substances. The arrangement of the burners 6 the fuel fire of which supplements the flue gases on the third zone C and air intake ports 9 in the first part C' of the zone C is preferably the same as that described above in connection with the second zone B of the furnace and with reference to FIGS. 4 and 5. In the second part C'' of the third zone, the release of volatile substances from the binder in the carbonaceous bodies CA is at a minimum, and accordingly, in this part C'', there may be only provided burners 6 which may be arranged in any suitable way.

Figure 3:
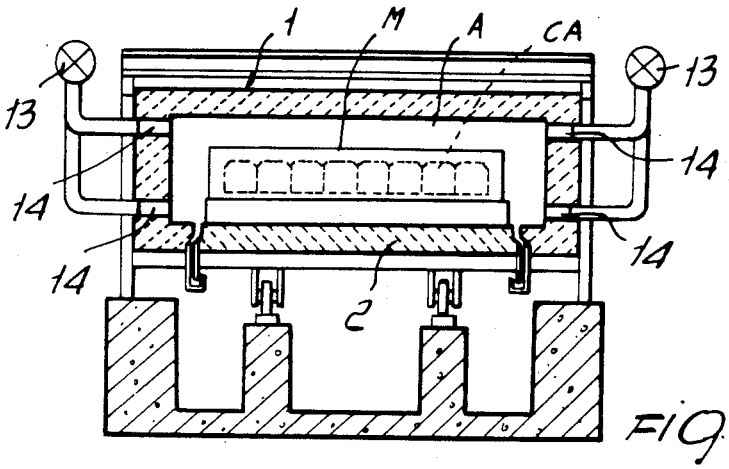
FIGS. 3, 4 and 5 show cross-sections taken through the furnace along the lines III—III, IV—IV and V—V in FIG. 1.

The intermediate outlet 11 for the extraction of flue gases from the furnace between the two zones B and C may have any desired design, and be preferably equipped with an extractor or ejector 12 in the manner shown in FIG. 1. The flue gases drawn through the outlet 11 are passed over a duct 112 to the first zone A of the furnace, whereinto they are introduced via manifolds 13 and side or intake ports 14 suitably distributed in the length and height directions of said zone A, as shown in FIGS. 1 and 3. The flue gases are extracted from the first zone A close to the start thereof and exhausted to the atmosphere by means of an extractor or ejector or, as shown in FIG. 1, of an induced and/or natural draft flue 15 constituting main outlet means for the flue gases in the furnace.

In the zone D, the carbonaceous bodies CA already calcined are cooled in a forced fashion by blowing cool air from one or more fans 16 through side or ingress ports 17 distributed along the length and height of the zone D. The heated air by the process of cooling the carbonaceous bodies CA, which has a temperature in the about 400° to 600° C. range, is drawn from the start of the zone D at the egress port 19' by means of either one or more suction fans 19 or by means of extractors or ejectors, and may be utilized in a preheating furnace, if any, for the carbonaceous bodies CA and/or as combustion air for the burners 6 in the zones B and C and/or as combustion air supplied through the inlet ports 9 into the zones B and C to burn off the volatile substances and/or as heated air for injection into the zones A,B and C as a back-up heating medium in these zones.

In the above-described embodiment of the furnace 1, in the zone A of the latter, there is established a stream of first zone flue gases toward the flue 15 at the start of this zone, and accordingly, in the opposite direction to the direction F1 of movement of the trucks 2 through the furnace 1. Thus, in the zone A of the furnace, the carbonaceous bodies CA are heated in a countercurrent manner and, hence, with a high thermal efficiency.

In the zones B and C, the flue gases flow to the intermediate outlet 11 and, hence, in the zone B a stream of second zone flue gases is formed flowing cocurrently with the movement F1 of the trucks 2 in the zone B and in the zone C a stream of third zone flue gases is formed flowing countercurrently to the movement F1 of the trucks 2 in the zone C. Thus, the carbonaceous bodies CA are heated cocurrently through the zone B and, hence, with inferior thermal efficiency, but this disadvantage of comparatively minor import is amply compensated for by that the flue gases containing the volatile substances emitted by the binder in the carbonaceous bodies CA are conveyed to the end part of the zone C, where the temperature TA of the furnace atmosphere reaches levels in the approximate range of 750° to 850° C., ensuring complete combustion of said volatiles in the flue gases. In the next zone C, instead, the furnace temperature is at a higher level than about 750°-850° C. already at the start of the zone C, thereby heating the carbonaceous bodies countercurrently appears to be preferable to achieve higher efficiency in the exchange of heat. Any volatile substances released from the binder in the carbonaceous bodies CA, in the second part C'' of the zone C having no air intake or inlet ports 9, are entrained by the countercurrent stream of flue gases back into the preceding part C' of the zone C, which is equipped with air intake or inlet ports 9. By virtue of the above arrangement, in the zones B and C of the furnace there takes place complete combustion of the volatile substances from the binder in the carbonaceous bodies CA. Consequently, those flue gases which are picked up at the intermediate outlet 11 between the two zones B and C and used to heat the carbonaceous bodies CA countercurrently in the first zone A whence they are finally exhausted into the outside atmosphere, are free of volatile organic substances and apt to produce no pollution. Thus, for example, the organic substance content of the flue gases drawn through the intermediate outlet 11 between the two zones B and C of the furnace 1 according to the invention may be reduced to about 0.60 mg/Nm$^3$, which represents a negligible level, far lower than that present in the flue gases exhausted by prior furnaces. The flue gases drawn out of the first zone A of the inventive furnace 1, being completely free of polluting matter, and in particular of tarry substances, instead of being released to the atmosphere, could be utilized without difficulty in one or more heat exchangers to further recover further sensible heat therefrom.

In the flue gas duct 112 between the intermediate outlet 11 of the zones B,C and the first zone A, there may be provided a flue gas analyzer 20, such as an analyzer of $O_2$, effective to monitor the degree of combustion of the volatile substances from the binder in the carbonaceous bodies CA. This analyzer 20 can control and change automatically the flow rate from the fan 18 which delivers air to the intake ports 9 of the zones B and C of the furnace 1, so as to automatically adjust the amount of oxygen in said zones and maintain it at levels suiting complete combustion of said volatile substances. Complete combustion of these volatile substances is ensured, for example, when the flue gases drawn through the intermediate outlet 11 between the zones B and C have an oxygen concentration of at least 1% by volume, referred to the volume of the dry gases present.

In order to ensure, even in special cases, the total absence of any volatile substances from the binder in the carbonaceous bodies CA in the flue gases released to the atmosphere from the first zone A of the furnace 1 through the flue 15, there may be provided a post-combustion chamber 21 to be arranged in the flue gas duct 112, between the extractor or ejector 12 and the manifolds 13 for the ports 14 of the first zone A of the furnace 1, as shown by the chain lines in FIG. 1, or downstream of the first zone A of the furnace, between the zone A and respective flue gas exhaust 15 to the atmosphere.

In the fourth zone D of the furnace, cooling of the carbonaceous bodies CA already calcined is carried out countercurrently, since the cooling air is drawn from the start of the zone D, thereby even in this zone maximum thermal efficiency can be achieved.

Figure 2:
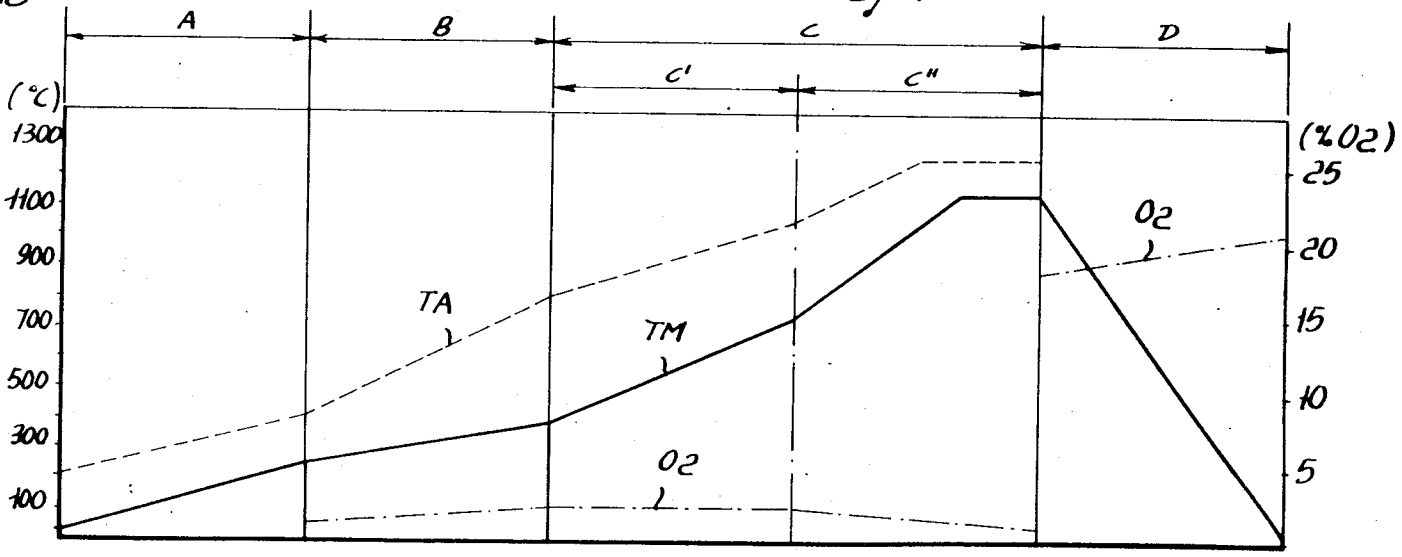
FIG. 2 Shows graphs for the temperature TA of the furnace atmosphere, temperature TM of the carbonaceous bodies being calcined, and percentage of $O_2$ in the furnace atmosphere, along the longitudinal extension of the furnace illustrated in FIG. 1.

The aforesaid conditions in the temperature TA of the furnace atmosphere and of the average temperature TM of the carbonaceous bodies CA are evident (FIG. 2), as are those of the percentage of oxygen $O_2$ referred to the dry gases, in the various zones A,B, C, and D of the furnace 1, in one exemplary embodiment thereof. More specifically, it may be appreciated that in the zones B and C of the furnace, wherein the volatile substances released by the binder in the carbonaceous bodies CA are burned off, the oxidizing atmosphere or medium in the furnace has a sufficient concentration of oxygen $O_2$ to ensure combustion of said volatile substances, in particular of at least 1% of $O_2$ by volume referred to the volume of total dry gases present, in combination with the flow of the flue gases cocurrently with the movement of the carbonaceous bodies CA through the zone B and countercurrently through the zone C, and in combination with a temperature TA of the furnace atmosphere which rises from about 350°–400° C. at the start of the zone B up to about 750°–850° C. at the end of that zone and to about 1000° C. at the end of the first part C' of the following zone C. It should be noted that FIGS. 1 and 2 are very schematical, especially as regards the lengths of the individual zones A,B,C,D, which may have any selected lengths both in absolute value and relatively to one another.

Figure 9:
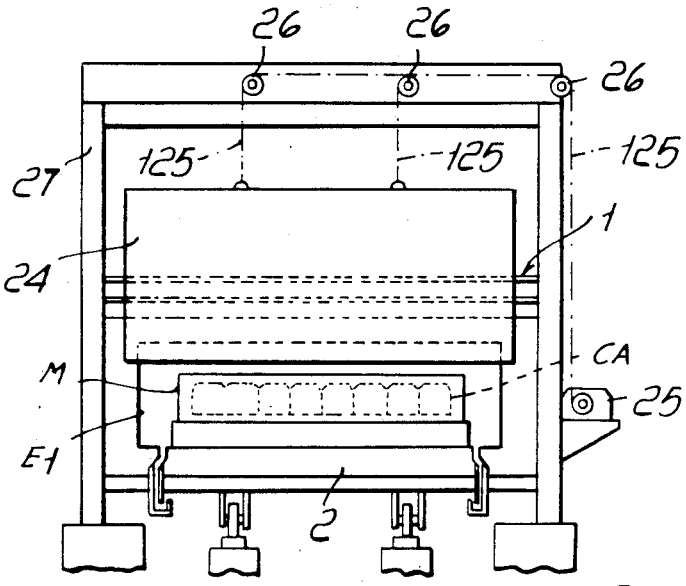
FIG. 9 is a front elevation view of a gate on the inlet end of one of the furnace sections, taken in the direction of arrows IX—IX in FIG. 7.
Figure 7:
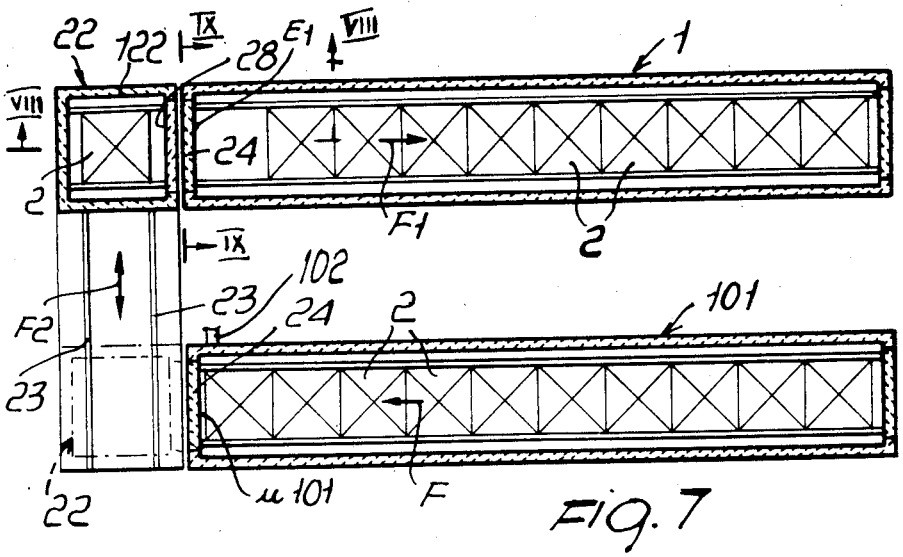
FIGS. 7 is a horizontal schematic section showing a tunnel type furnace according to the invention, as divided into side-by-side sections interconnected by a transfer carriage for the individual trucks loaded with carbonaceous bodies being calcined.
Figure 8:
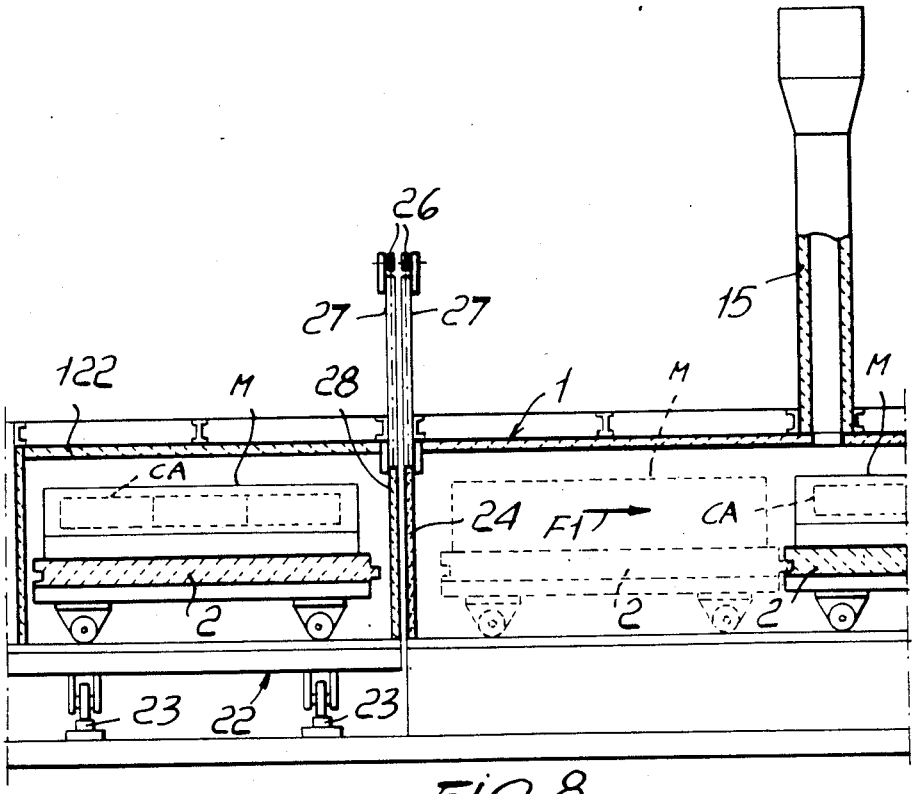
FIG. 8 is an enlarged scale, partial vertical section view taken along the line VIII—VIII in FIG. 7.

In FIGS. 7, 8 and 9, there is shown an embodiment of the tunnel type furnace according to the invention which affords the faculty of avoiding an excessive long furnace and consequent difficulties in propelling the trucks 2. In this emebodiment, the tunnel type furnace is divided into two side-by-side sections parallel to each other, one of which is configured as a preheating tunnel 101 and the other as a tunnel type heating and firing furnace 1. Carbonaceous bodies CA to be calcined, being accommodated either in muffles M or mere supports (not shown) and loaded onto trucks 2, are first caused to move through the preheating tunnel furnace in the direction of the arrow F, and then through the heating and firing tunnel furnace 1 in the direction of the arrow F1. In the preheating furnace 101, the carbonaceous bodies CA are heated, for example, to a temperature of about 200°–250° C. The trucks 2 with the carbonaceous bodies CA to be calcined travel next in the direction F1, i.e. in the opposite direction to F, through the next heating/firing furnace 1 which is configured and operated in the same manner as described above in relation to FIGS. 1 to 6. The carbonaceous bodies CA enter the first zone A of this furance 1 at a temperature of about 200°–250° C. and reach, at the end of this first zone A, a temperature of about 250°–300° C., substantially as previously explained. Consequently, the zone A of the furnace 1 can be made shorter. In the preheating furnace 101, the carbonaceous bodies CA can be heated countercurrently either with flue gases coming from the main outletor exhaust 15 or with hot air from the cooling zone D of the successive heating-/firing furnace 1, the flue gases or the hot air reaching the preheating furnace 101 through conduit means 1O2.

To prevent the carbonaceous bodies CA from being cooled while moving from the preheating tunnel furnace 101 to the heating/firing tunnel furnace 1 alongside, as well as to eliminate the risk of enhanced oxidation of the powder filler in the muffles M during the passage and to minimize thermal losses, the invention provides for the trucks 2 with the carbonaceous bodies to be transferred from the outlet U101 of the preheating furnace 101 to the inlet E1 to the heating/firing furnace 1 alongside by means of a transfer carriage 22 having a closed insulated bin 122, whereinto the trucks 2 are received for their transference. The transfer carriage 22 moves in the directions of the double arrow F2 along rails 23 which extend across the two sections 1 and 101 of the furnace in front of the outlet U101 from the preheating furnace 101 and of the inlet E1 to the heating-/firing furnace 1. The inlet E1 to the furnace 1 and the outlet U101 from the preheating furnace 101 are equipped with vertically slideable gates 24 which can be raised and lowered by means of a power winch 25, for example, the ropes 125 whereof are trained around pulleys 26 mounted above on a portal frame 27. The gate 24 is suspended from these ropes 125, in particular as shown in FIG. 9. On its side facing the two sections 1 and 101 of the furnace, the bin 122 of the transfer carriage 22 is provided with a similar vertically slideable gate 28. On the transfer carriage 22 locating itself on the rails 23 in front of the outlet U101 of the preheating furnace 101, as shown by chain lines in FIG. 7, the gates 24 and 28 of that outlet U101 and the insulated bin 122 of the carriage 22 are opened, and a truck 2 from the preheating furnace 101 is introduced into the bin. The gates 28 of the carriage 22 and 24 of the outlet U101 are then closed, and the carriage is taken on the rails 23 to the inlet E1 of the heating/firing furnace 1, as shown by full lines in FIG. 7. Thereupon, the gates 24 and 28 of said inlet E1 and the insulated bin 122 of the transfer carriage 22 are opened and the truck 2 contained therein is moved into the furnace 1, wherein it continues to move in the direction of the arrow F1. The transfer carriage 22 is moved back to the outlet U101 of the preheating furnace 101 ready to receive the next truck 2 to be transferred into the heating/firing furnace 1.

Of course, the invention is not restricted to the embodiments thereof just described and illustrated, and may be varied and modified within broad limits, especially construction-wise and as relates to technical equivalents, without departing from the inventive concept disclosed hereinabove and claimed in the appended claims.

We claim:

1. A method for calcining carbonceous bodies, in particular electrodes comprising:

passing preformed bodies to be calcined and made of a mixture of carbonaceous material and a pyrolyzable substances containing binder through a first zone of a tunnel type furnace and simultaneously preheating said preformed bodies by means of a stream of first zone flue gases caused to flow countercurrently to the movement of said preformed bodies, passing thereafter said so preheated preformed bodies through a second zone of said tunnel type furnace and simultaneously supplying oxygen containing gases in said second zone and causing therein substantially complete combustion of volatile components of said pyrolyzable substances and creating therein a stream of second zone flue gases caused to flow cocurrently with the movement of said preformed bodies, while maintaining in said second zone a furnace temperature suitable for said complete combustion of said volatile components and in the furnace atmosphere at least of said second zone and oxygene content of at least 1% by volume and simultaneously substantially preventing passage of said stream of second zone flue gases into said first zone and passage of said first zone flue gases into said second zone, passing thereafter said so treated preformed bodies through a third zone of said tunnel type furnace and simultaneously causing in said third zone a stream of third zone flue gases to be established countercurrently to the movement of said preformed bodies and supplying at least in a portion of said third zone adjoining at least one intermediate flue gases outlet provided in said tunnel type furnace in a location arranged between said second and said third zones further oxygen containing gases to provide a sufficient oxygene content therein to ensure substantially complete combustion of said volatile components during the time period the preformed bodies advance through said third zone, said first flue gases preheating said preformed bodies in said first zone being drawn from said intermediate outlet and introduced into said first zone countercurrently to the movement of said preformed bodies through said first zone of said tunnel type furnace and withdrawn therefrom through outlet means provided at an entrance end of said first zone, and passing thereafter said preformed bodies through a fourth zone of said tunnel type furnace while simultaneously blowing cooling air countercurrently to the movement of said preformed bodies through said fourth zone and towards air outlet means provided at an initial portion of said fourth zone where cooling air is withdrawn and simultaneously substantially preventing passage of said cooling air from said fourth zone into said third zone of said tunnel type furnace.

2. A method according to claim 1, wherein in said first zone said preformed bodies are preheated up to a temperature of about 200°-300° C.

3. A method according to claim 2, wherein the temperature of the furnace atmosphere in said first zone is maintained at about 350°-400° C.

4. A method according to claim 1, wherein in said second zone said preformed bodies are heated up to a temperature of about 350°-450° C.

5. A method according to claim 4, wherein the temperature of the furnace atmosphere in said second zone is maintained at about 750°-850° C.

6. A method according to claim 1, wherein in said third zone said preformed bodies are heated up to a temperature of about 1000°-1200° C.

7. A method according to claim 6, wherein the temperature of the furnace atmosphere in said third zone is maintained at about 1200°-1300° C.

8. A method according to claim 1, wherein said second zone flue gases and said third zone flue gases are supplemented by means of fuel fired burners directing fuel fire thereof into said second and said third zone of said tunnel type furnace.

9. A method according to claim 1, wherein said oxygen containing gases comprise air at a selected temperature for maintaining a preestablished temperature in said second zone.

10. A method according to claim 1, wherein said further oxygen containing gases comprise air at a selected temperature for maintaining a desired temperature in said third zone.

11. A method according to claim 1, wherein said second and third zone flue gases and said oxygen containing gases and said further oxygen containing gases are caused to create turbulent flow in said second and third zones of said tunnel type furnace.

12. A method for calcining carbonaceous bodies, in particular electrodes comprising:

passing preformed bodies to be calcined and made of a mixture of carbonaceous material and a pyrolyzable substances containing binder through a first zone of a tunnel type furnace and simultaneously preheating said preformed bodies up to a temperature range between 200° and 300° C. by means of a stream of first zone flue gases caused to flow countercurrently to the movement of said preformed bodies and maintaining the furnace atmosphere in said first zone at a temperature range between 350° and 400° C., passing thereafter said so preheated preformed bodies through a second zone of said tunnel type furnace and directing fuel fire of fuel fired burners into said second zone and simultaneously supplying air at a selected temperature in said second zone and causing therein substantially complete combustion of volatile components of said pyrolyzable substances and creating a turbulent stream of second zone flue gases caused to flow cocurrently with the movement of said preformed bodies, while maintaining in said second zone a furnace temperature in the range between 750° and 850° C. for heating said preformed bodies to a temperature range between 350° and 450° and suitable for said complete combustion of said volatile components and in the furnace atmosphere at least of said second zone an oxygene content of at least 1% by volume and simultaneously substantially preventing passage of said stream of second zone flue gases into said first zone and passage of said first zone flue gases into said second zone, passing thereafter said so treated preformed bodies through a third zone of said tunnel type furnace and directing fuel fire of fuel fired burners into said third zone to supplement third zone flue gases flowing through said third zone and heating therein said preformed bodies up to a temperature range between 1000° and 1200° C. and maintaining the furnace atmosphere in said third zone at a temperature range between 1200° and 1300° C. and simultaneously causing in said third zone a turbulent stream of said third zone flue gases to be established countercurrently to the movement of said preformed bodies and supplying, at least in a portion of said third zone adjoining at least one intermediate flue gases outlet provided in said tunnel type furnace in a location arranged between said second and said third zones, further air to provide a sufficient oxygene content therein to ensure substantially complete combustion of said volatile components during the time period the preformed bodies advance through said third zone, said air being supplied at a selected temperature suitable to maintain in said third zone said temperature range of the furnace atmosphere, said first zone flue gases preheating said preformed bodies in said first zone being drawn from said intermediate outlet and introduced into said first zone countercurrently to the movement of said preformed bodies through said first zone of said tunnel type furnace and withdrawn therefrom through outlet means provided at an entrance end of said first zone, and passing thereafter said preformed bodies through a fourth zone of said tunnel type furnace while simultaneously blowing cooling air countercurrently to the movement of said preformed bodies through said fourth zone and towards air outlet means provided at an initial portion of said fourth zone where cooling air is withdrawn and simultaneously substantially preventing passage of said cooling air from said fourth zone into said third zone of said tunnel type furnace.

13. A tunnel type furnace apparatus for calcining carbonaceous bodies of the type comprising a mixture of a carbonaceous material and a pyrolyzable substances containing binder, particularly for electrodes, wherein the furnace apparatus comprises, a tunnel structure and truck means movable through said tunel structure for carrying on said truck means said carbonaceous bodies to be conveyed through said tunnel structure and calcined therein, said tunnel structure having a longitudinal extension and an entrance end for introducing therein said truck means and an exit end at a longitudinal downstream distance from said entrance end for removing therethrough said truck means from said tunnel strucutre, first apertured partition means in said tunnel structure at a first longitudinal distance from said entrance end for substantially preventing gas flow therethrough while allowing close passage of said truck means through said apertured partition means, said first longitudinal distance defining a first portion of said tunnel structure establishing between said entrance end and said apertured partition means a first preheating zone of said tunnel structure, intermediate outlet means in said tunnel strucutre arranged at a second longitudinal downstream disatance from said first apertured partition means, said second longitudinal distance defining a second portion of said tunnel structure establishing between said first apertured partition means and said intermediate outlet a second combustion heating zone of said tunnel structure, said intermediate outlet means being effective to withdraw flue gases from said second portion of said tunnel structure to create a downstream flow of said flue gases therein cocurrently with the advancement of said truck means through said second tunnel structure portion, second apertured partition means in said tunnel strucutre at a third longitudinal downstream distance from said intermediate outlet means, said third longitudinal distance defining a third portion of said tunnel strucure establishing between said intermediate outlet means and said second apertured partition means a third calcining zone of said tunnel structure, said intermediate outlet means being additionally effective to withdraw flue gases from said third tunnel structure portion to create an upstream flow of flue gases therein, countercurrently to the downstream advancement of said truck means therethrough, said second apertured partition means being arranged at a fourth longitudinal upstream distance from said exit end of said tunnel structure, said fourth longitudinal distance defining a fourth portion of said tunnel structure establishing between said second apertured partition means and said exit end a fourth cooling zone of said tunnel structure, first intake ports in said first portion of said tunnel strucutre and duct means connecting said intermediate outlet means with said first intake ports to convey flue gases from said intermediate outlet means to said first intake ports, main outlet means at the entrance end of said tunnel structure for withdrawal of flue gases from said first tunnel portion and for creating an upstream flow of said flue gases in said first portion of said tunnel strucutre from said first apertured partition means towards said main outlet countercurrently to the advancement of said truck means therethrough, a plurality of burners arranged in the reach of said second and third portions of said tunnel structure to direct fuel fire thereof into said second combustion zone and into said third calcining zone, a plurality of inlet ports for oxygen containing gases located in said second portion of said tunnel structure and at least in an area of said third tunnel portion close to said intermediate outlet to ensure substantially complete combustion of any volatile components released from said pyrolyzable substances of said binder, said burners and said inlet ports for oxygene containing gases located in said second and third tunnel portions having a position respectively favoring cocurrent flow of flue gases with respect to the advancing movement of said truck means within said second tunnel structure portion and favoring countercurrent flow of flue gases with respect to the advancing movement of said truck means within said third tunnel portion and ingress and egress ports for cooling air located in said fourth tunnel portion mutually positioned to favour countercurrent flow of flue gases with respect to the advancemente movement of said truck means within said fourth tunnel portion.

14. An apparatus according to claim 13, wherein said inlet ports for blowing oxygen containing gaes into said second and said third tunnel portions are arranged on opposite tunnel structure sidewalls at diagonally opposite cross-sectional positions to ensure thereby a turbulent flow of air in said second and said third tunnel structure portions.

15. An apparatus according to claim 13, wherein said inlet ports for blowing oxygen containing gases into said second and said third tunnel portions are arranged in mutually longitudinally offset positions on opposite side walls of the tunnel structure.

16. An apparatus according to claim 13, wherein said burners in said second and said third tunnel structure portions are arranged in mutually longitudinally offset positions on opposite side walls of the tunnel structure.

17. An apparatus according to claim 13, wherein said apertured partition means between said first and said second tunnel structure portions and between said third and said fourth tunnel structure portions comprise a single-walled partition wall having an aperture therein for closely admitting passage therethrough of said truck means with said carbonaceous bodies loaded thereon.

18. An apparatus according to claim 13, wherein said apertured partition means between said first and said second tunnel structure portions and between said third and said fourth tunnel strucutre portions comprise a double walled partition wall having an aperture therein defining an inner periphery thereof for closely admitting passage therethrough of said truck means with said carbonaceous bodies loaded thereon, said double-walled partition wall defining an interspace along at least a part of said periphery, the apparatus further comprising conduit means for connecting said interspace with the outside atmosphere.

19. An apparatus according to claim 13, wherein said duct means connecting said intermediate outlet means with said first intake ports are arranged outside the tunnel structure and comprise flue gas analyzer means including an $O_2$ analyzer, operative to monitor the presence of volatile substances released from the binder in the carbonaceous bodies and the oxygen concentration in the flue gases passing through said duct means and to control the blowing of air into said second and said third tunnel structure portions.

20. An apparatus according to claim 13, wherein said first tunnel strucuture portion defining said preheating zone includes a separate tunnel furnace spaced apart from said first tunnel structure portion for partially preheating said carbonaceous bodies therein, said separate tunnel furnace having an own exit end with gate means for alternatively closing and opening said own exit end thereof and transference means for the transfer of said truck means from said separate tunnel furnace towards said first tunnel structure portion, said entrance end of said tunnel structure having further gate means for alternatively closing and opening said entrance end thereof for the selective transfer of said truck means into said first tunnel structure portion, thereby to reduce the length of said first tunnel structure portion.

21. An apparatus according to claim 20, wherein said separate tunnel furnace comprises conduit means for conveying flue gases from said first tunnel structure portion to said separate tunnel furnace countercurrently to the advancement of said truck means therethrough.

22. An apparatus according to claim 13, wherein said first tunnel strucuture portion defining said preheating zone includes a separate tunnel furnace spaced apart from said first tunnel structure portion for partially preheating said carbonaceous bodies therein, said separate tunnel furnace having an own exit end with gate means for alternatively closing and opening said own exit end thereof and transference means for the transfer of said truck means from said separate tunnel furnace towards said first tunnel structure portion, said entrance end of said tunnel structure having further gate means for alternatively closing and opening said entrance end thereof for the selective transfer of said truck means into said first tunnel structure portion, thereby to reduce the length of said first tunnel structure portion and wherein said separate tunnel furnace comprises conduit means for conveying cooling air coming from said egress port of said fourth tunnel structure portion into said separate tunnel furnace countercurrently to the advancement of said truck means therethrough.

23. An apparatus according to claim 13, wherein said burners are distributed over the length of said second and said third tunnel structure portions at cross-sectionally diagonally opposite locations for ensuring a turbulent flow of the produced flue gases in said second and third tunnel structure portions.

* * * * *